United States Patent [19]

Queen et al.

[11] 4,022,087

[45] May 10, 1977

[54] METHOD OF AND APPARATUS FOR CUTTING SHEET MATERIAL

[75] Inventors: David S. Queen; John Mitchell, both of Sanquhar, England

[73] Assignee: Sidlaw Industries Limited, Dundee, Great Britain

[22] Filed: Mar. 2, 1976

[21] Appl. No.: 663,091

[52] U.S. Cl. ..... 83/27; 83/55; 83/156; 83/436

[51] Int. Cl.[2] ..... B26D 7/06

[58] Field of Search ..... 83/27, 55, 103, 156, 83/157, 436

[56] References Cited

UNITED STATES PATENTS

| | | | |
|---|---|---|---|
| 2,933,966 | 4/1960 | Dehn | 83/157 X |
| 3,260,145 | 7/1966 | Giordano | 83/187 X |

*Primary Examiner*—Travis S. McGehee
*Attorney, Agent, or Firm*—Brady, O'Boyle & Gates

[57] ABSTRACT

A method of and apparatus for blanking products from pliable sheet material where the material to be cut is supported on a planar support member within the peripheral shape of the final product and after the blanking process has been completed a product-discharge roller is moved through an aperture in the supporting surface to lift the cut product clear of the cutting edge and discharge the product from the cutting apparatus. Additionally, the cutting edge has a portion which separates the cut product and its peripheral waste from incoming material and the peripheral waste is positively discharged from the apparatus by a conveyor arrangement located externally of the cutting edge which defines the products peripheral shape.

12 Claims, 4 Drawing Figures

METHOD OF AND APPARATUS FOR CUTTING SHEET MATERIAL

This invention relates to a method of and apparatus for blanking products from pliable sheet material.

Known forms of apparatus for cutting sheet material comprise a planar platen against which the material to be cut is biassed by a cutting head which supports the cutting blade. In the case where the cutting head is mounted beneath the platen and intermittently stamps out or blanks the required shape of product from the sheet material during semi-continuous passage of the sheet material through the apparatus there exists the disadvantage that the cut product tends to become lodged within the cutting blade and this produces a fold in the incoming material between the cutting head and the platen which prevents proper functioning of the apparatus. Additionally, these known forms of apparatus rely upon the incoming sheet material pushing out the previously cut material from between the platen and the cutting head, and this leads to difficulties in that the incoming material may ride over the cut material to form a second layer. This then prevents proper functioning of the apparatus.

It is an object of the present invention to provide an improved form of apparatus for cutting pliable sheet material.

According to the present invention there is provided a method of blanking products from pliable sheet material in a cutting apparatus, comprising supporting the material to be cut within the cutting apparatus on a planar support member having an aperture positioned within the peripheral shape of the product to be cut, cutting a product from the supported material with a cutting edge peripherally defining the shape of the product, thereafter moving a drive roller through said aperture into engagement with the cut product, and rotatably driving said roller to remove the cut product from the cutting apparatus.

Further according to the present invention there is provided cutting apparatus for blanking products from pliable sheet material, said apparatus comprising opposed upper and lower members which are normally spaced apart to receive pliable sheet material to be cut, a cutting blade carried by the lower one of said members and having a cutting edge defining the peripheral shape of the product to be cut from said material, a planar support element located within the confines of said peripheral shape, said support element having an aperture therein, a roller mounted on said lower member and movable through said aperture to and from an ambush position in which the roller is depressed below the plane defined by said cutting edge.

Still further, the present invention provides cutting apparatus for blanking products from pliable sheet material, said apparatus comprising opposed upper and lower members which are normally spaced apart to receive pliable sheet material to be cut, a cutting bed carried by the lower one of said members and co-operable with a cutting blade carried by the upper one of said members, said cutting blade having a cutting edge defining the peripheral shape of the product to be cut from said material, a planar support element mounted on said lower member and located within the confines of said peripheral shape, said support element having an aperture therein, a roller mounted on said lower member and movable through said aperture to and from an ambush position in which the roller is depressed below the plane defined by said cutting bed.

An embodiment of the present invention will now be described by way of example with reference to the accompanying drawings in which.

Figure 1:
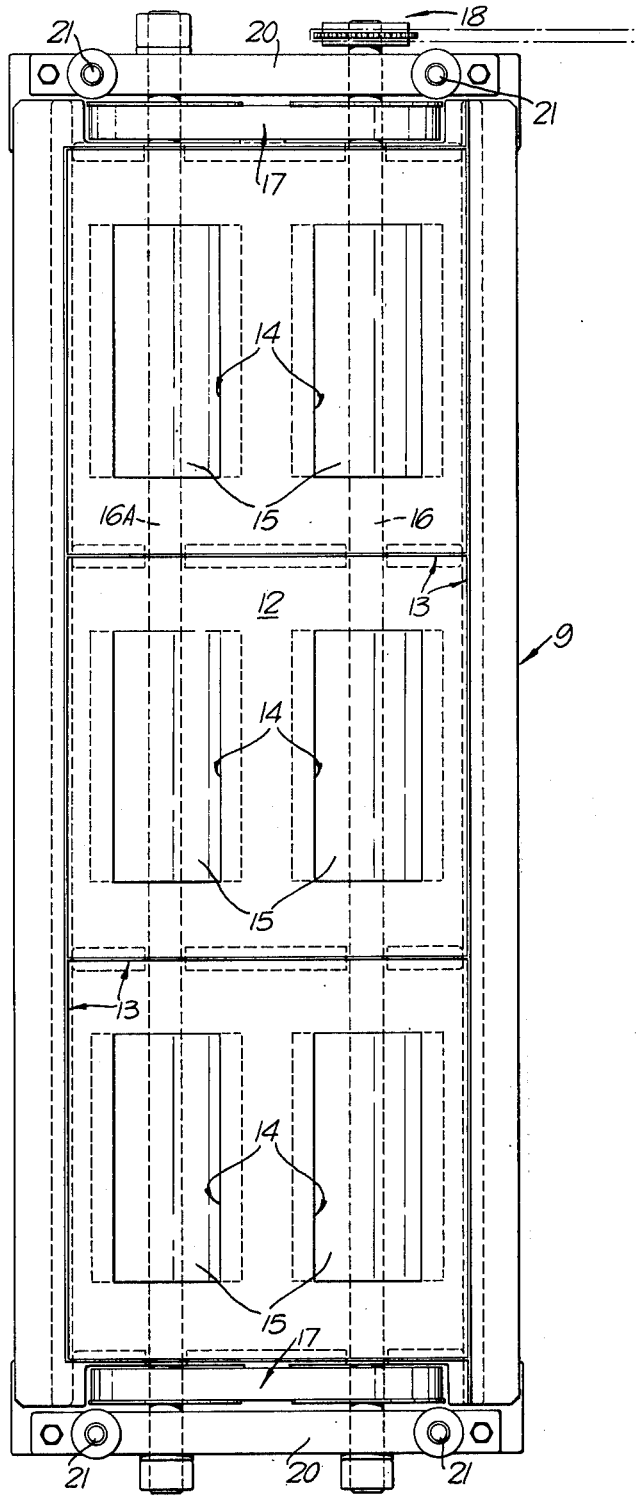
FIG. 1 is a plan view of part of the apparatus.

Apparatus for cutting sheet material comprises a cutting head 9 (shown in FIG. 1) having a base plate 10 which is adapted to be securely fixed to a stationary support. The base plate 10 supports upstanding limbs 11 which carry a rigid holder 12 for a cutting blade 13 having a cutting edge 13A. The blade 13 is secured to the holder 12 by clamping elements and screws and the holder 12 is interchangeable on the limbs 11 to permit blades 13 of different shapes and sizes to be accommodated. The blade 13 illustrated in the drawings defines three rectangles adjacent ones of which have a common side. The holder 12 within each of these rectangles forms a planar support surface which is apertured, for example, at 14 and a roller 15 is mounted to project through each aperture 14. As illustrated, three rollers 15 are mounted on a shaft 16 and another three rollers 15 are mounted on a parallel shaft 16A, the shafts 16 and 16A being interconnected by belt drive arrangements 17, and the shaft 16 carries a sprocket wheel 18 which is driven by a chain drive, as will be explained, from a remote drive motor. The sprocket wheel 18 incorporates an over-run of freewheel arrangement. If so desired the arrangements 17 could incorporate a chain drive and the wheel 18 could take the shape of a pulley to permit operation by a drive belt.

The shafts 16, 16A are carried at each end by a member 20 which is slidably mounted on two posts 21 secured to the base plate 10, each member 20 being resiliently biassed away from the base plate 10 by springs 22. A stop 23 is provided on each post 21 to limit the movement of the members 20 away from the base plate 10 and when in this limiting position the rollers 15 project above the plane 19 defined by the cutting edge 13A of the cutting blade 13.

Figure 2:
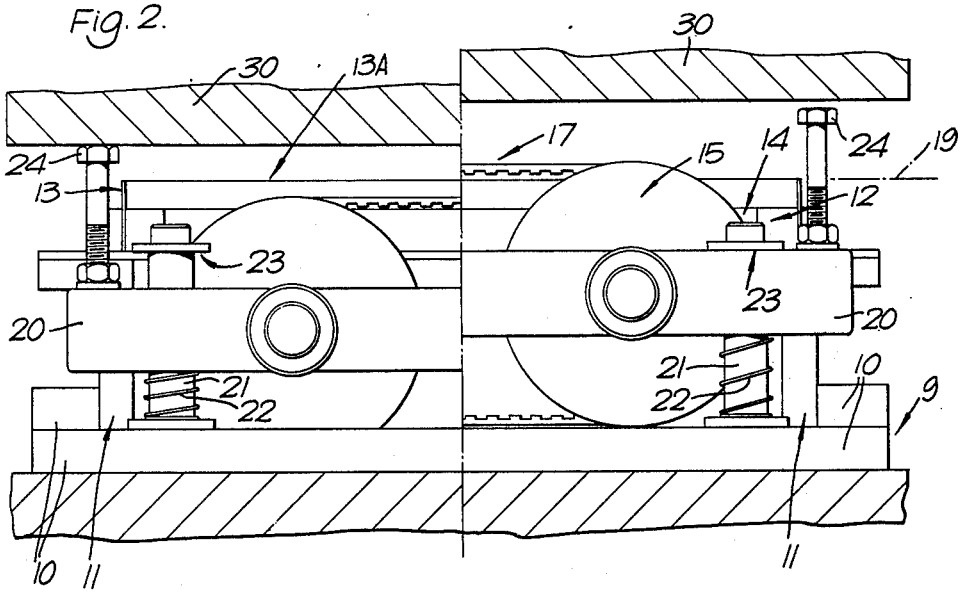
FIG. 2 is an end elevation of the apparatus with the right hand half showing the platen member in its raised position and the left hand half showing the platen member in a lowered position.

When the members 20 are moved to compress the springs 22 the rollers 15 are moved into an ambush position in which they no longer project beyond (i.e. above) the plane 19 defined by the cutting edge 13A of the cutting blade 13 and when the rollers 15 are in this ambush position the apparatus is ready to cut sheet material. Immediately prior to the cutting action a platen member 30 (FIG. 2) is controlled by means (not shown) to move downwardly from its position illustrated in the right hand half of FIG. 2 towards the cutting head 9. Adjustable stops 24 are mounted on the members 20 of the head 9 and these are abutted by the platen member 30 which, in its travel towards the cutting blade 13, causes the rollers 15 to be driven into ambush.

In operation of the apparatus described herein the pliable or flexible sheet material to be cut is fed to the gap formed between the cutting head 9 and the platen member 30 and after a cutting action has been performed and the platen member 30 retracted, the cut product is positively driven out of the cutting apparatus by the rollers 15 and consequently the danger of the cut product becoming trapped within the apparatus is considerably reduced. Additionally, the waste material bounding the cut product on each side is positively drive out of the apparatus by conveyor means in the form of the arrangements 17 located laterally of the blade 13. In consequence the apparatus is free of both product and waste before incoming materials to be cut enters the apparatus.

Figure 3:
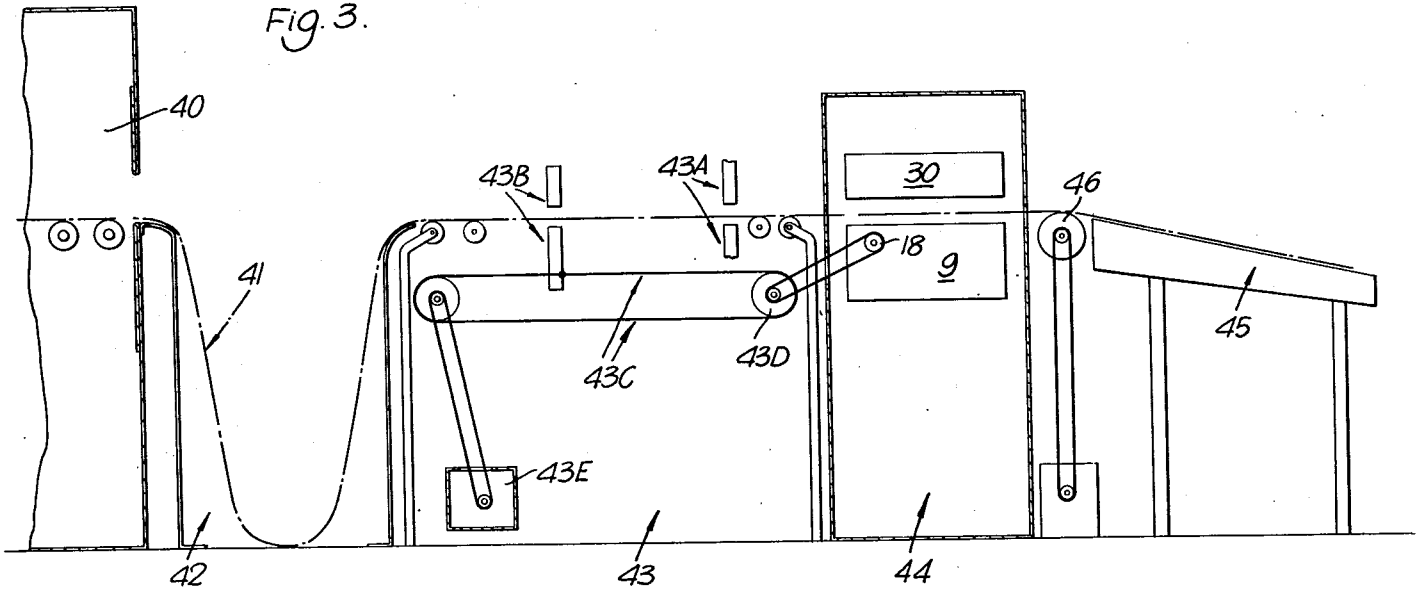
FIG. 3 shows the apparatus forming part of a carpet-tile production line.

The above described embodiment of cutting apparatus is particularly adapted to be utilised within a production line where lengths of carpet pile-forming material are backed with a thick layer of heavy plastics material such as PVC. As is illustrated in FIG. 3 a continuous length of PVC-backed carpeting is formed at an output stage 40 which may conveniently be in the form of an air-cooling unit and the material 41 with its pile surface uppermost is fed into an accumulator 42 which may provide for one or more loops of material. The material 41 from the accumulator 42 is fed through an intermittently-operable measuring and feeding device 43 which feeds measured lengths of material into the above described cutting apparatus 44 from whence cut carpet tiles and trimmed waste are ejected along a run-out table 45. The method of cutting is as described in the U.K. Patent Specification No. 1336708 whereby the PVC backing is cut by the blade 13 and the pile surface is left uncut so that a pile fringe is formed around each carpet tile. For this reason the cutting edge 13A does not contact the platen member 30.

The measuring and feeding device 43, in addition to a support for the carpeting, includes a first pair of carpet-clamping jaws 43A between which the carpeting passes, the upper jaw 43A being movable relative to the lower jaw 43A which is stationary, and a second pair of jaws 43B between which the carpeting passes. The lower one of the jaws 43B is carried by a chain 43C entrained around spaced sprockets 43D and driven by a motor 43E and the upper jaw 43B is movable towards and away from the lower jaw 43B. The device 43 operates under the control of a sequencing device such that material such as carpeting 41 passing through both the first and second pair of jaws 43A, 43B is intermittently fed or indexed through the cutting apparatus 44 and the sprocket 18 of the apparatus 44 is driven from one of the sprockets 43D of the device 43.

The sequencing device controls the apparatus 44 and the device 43 such that when the platen member 30 moves to its down position in order to effect a cut the jaws 43B are adjacent the jaws 43A and both pairs of jaws clamp the material 41. Immediately after the platen member 30 is moved back to its up position the jaws 43B open and are moved away from the jaws 43A by operation of the motor 43E. Because of the driving connection between the sprockets 43D and 18 the rollers 15 within the apparatus 44 are rotatably driven causing the cut tiles to be ejected and because the arrangement 17 is driven during this stage waste carpeting is also ejected (it will be noted from FIG. 1 that the blade 13 adjacent the sprocket 18 has a portion which causes a complete lateral cut to occur thereby separating cut material and its waste from uncut material). A motor driven roller 46 assists the cut material and the cut waste onto the run-out table 45.

The traverse of the jaws 43B away from the jaws 43A is determined by a limit switch (not shown) and after actuation thereof the chain 43C temporarily becomes stationary, the jaws 43B close and the jaws 43A open. The motor 43E is thereafter re-energised to cause movement of the chain 43C in the reverse direction which moves the jaws 43B back towards the jaws 43A, thereby causing carpeting to be cut to be fed into the apparatus 44. Because the sprocket 18 incorporates a freewheel arrangement the rollers 15 are not driven during this movement of the chain 43C and are free to rotate under the influence of the incoming material 41. When the jaws 43B reach the jaws 43A a further limit switch is tripped causing the chain 43C to become stationary, the jaws 43A to close and the platen member 30 to move to the down position to effect the desired cut. Thereafter the cycle is repeated.

By way of modifications instead of cutting three carpet tiles across the width of the material 41 the blade 13 could be arranged to define any desired number of tiles in any appropriate number across the width and along the length of the material. Thus instead of the illustrated three gang cutter a six or eight gang arrangement could be utilised. Clearly, although two rollers 15 have been illustrated within the periphery of each tile, one or more rollers could be accommodated. In the case where there is a plurality of rollers within the periphery of each tile the rollers may drive a conveyor belt entrained therearound.

Although the drawings illustrate a sprocket 18 at one end of the shaft 16 each end could have sprockets 18 so that the shaft 16 can be driven in both directions. In this case the second sprocket would be arranged with its freewheel arrangement opposite to the previously described freewheel arrangement so that the rollers 15 would be driven during entry of material to be cut.

With a view to assisting in ejection of the cut material from the apparatus the blade holder 12 may support a spring loaded plate made of aluminium or a thick pad of resilient material such as rubber.

In the FIG. 3 production line the jaws 43B are laterally moved by a chain drive mechanism. In an alternative arrangement air cylinders are used and the lower jaw 43B is slidably mounted on parallel guide rods. The opening and closing of jaws 43A and 43B may likewise be effected by air cylinders and in this arrangement the motor 43E drives the sprocket 18 directly either by belt or chain.

Figure 4:
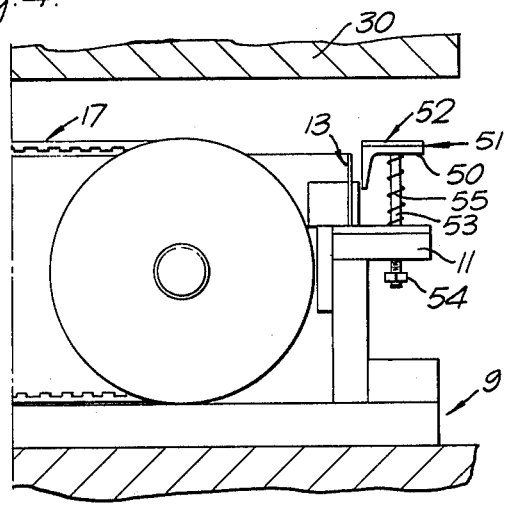
FIG. 4 illustrates a modification of a detail.

In a further modification which is illustated in FIG. 4 the cutting head 9 incorporates a resiliently mounted element 50 extending the full width of the apparatus and closely adjacent the cutting blade 13. The element 50 is arranged to have its upper surface 51 in or slightly above the plane 19 so that incoming material to be cut is not hindered by the presence of the blade 13. Additionally, the element 50 incorporates at each lateral edge thereof a pad 52 which acts as a centralising guide for the incoming material to be cut. This pad 52 extends inwardly from the lateral edges of the element 50 by less than the width of the drive arrangements 17, and the height of the pads 52 is sufficient to permit them to act as abutment elements for engagement by the platen member 30 during its downward motion. The element 50 carries a plurality of studs 53 which pass through part of the limbs 11 and engage nuts 54 which act as stops. Springs 55 surround the studs 53 and bias the element 50 away from the limbs 11. To effect lateral rigidity the element 50 may conveniently have an L-shaped cross section.

It will be appreciated that, in the interests of clarity, certain parts of the head 9 are not illustrated in FIG. 4.

For example member 20 and stop 24 together with associated components.

In a further arrangement the cutting blade is mounted above the platen member which incorporates a cutting bed shaped similarly to the cutting blade and within the cutting bed there is a support shaped in the same manner as the holder 12 and permitting the rollers 15 to function as described above. In this case the surface of the holder 12 would lie in the plane 19 as would the cutting bed.

We claim:

1. A method of blanking products from pliable sheet material in a cutting apparatus, comprising supporting the material to be cut within the cutting apparatus on a planar support member having an aperture positioned within the peripheral shape of the product to be cut, cutting a product from the supported material with a cutting edge peripherally defining the shape of the product, thereafter moving a drive roller through said aperture into engagement with the cut product, and rotatably driving said roller to remove the cut product from the cutting apparatus.

2. A method according to claim 1, wherein said cutting edge additionally separates the product and peripheral waste material from uncut material and after the cutting action conveyor means is brought into engagement with the sheet material lying outside said peripheral shape to remove waste material from the cutting apparatus.

3. A method according to claim 1, wherein said pliable sheet material is in the form of pile-forming material attached to a heavy backing layer of plastics material.

4. A method according to claim 3, wherein said support member engages said backing layer and said cutting edge engages and cuts said backing layer without cutting said pile-forming layer.

5. Cutting apparatus for blanking products from pliable sheet material, said apparatus comprising opposed upper and lower members which are normally spaced apart to receive pliable sheet material to be cut, a cutting blade carried by the lower one of said members and having a cutting edge defining the peripheral shape of the product to be cut from said material, a planar support element located within the confines of said peripheral shape, said support element having an aperture therein, a roller mounted on said lower member and movable through said aperture to and from an ambush position in which the roller is depressed below the plane defined by said cutting edge.

6. Cutting apparatus for blanking products from pliable sheet material, said apparatus comprising opposed upper and lower members which are normally spaced apart to receive pliable sheet material to be cut, a cutting bed carried by the lower one of said members and co-operable with a cutting blade carried by the upper one of said members, said cutting blade having a cutting edge defining the peripheral shape of the product to be cut from said material, a planar support element mounted on said lower member and located within the confines of said peripheral shape, said support element having an aperture therein, a roller mounted on said lower member and movable through said aperture to and from an ambush position in which the roller is depressed below the plane defined by said cutting bed.

7. Cutting apparatus according to claim 5, wherein said cutting edge is also shaped to separate the product and peripheral waste material from uncut material, conveyor means are mounted on said lower member and located outside said peripheral shape, and means interconnect said roller and said conveyor means.

8. Cutting apparatus according to claim 6, wherein said cutting edge is also shaped to separate the product and peripheral waste material from uncut material, conveyor means are mounted on said lower member and located outside said peripheral shape, and means interconnect said roller and said conveyor means.

9. Cutting apparatus according to claim 7, wherein said interconnecting means includes a rotational drive element, and control means is coupled to said drive element to control rotation of said drive element.

10. Cutting apparatus according to claim 5, wherein said roller is mounted on a spindle which is resiliently supported by said lower member, said resilient support biassing said roller out of said ambush position.

11. Cutting apparatus according to claim 5, including interengageable abutment elements respectively mounted on said upper and lower members and operable, when interengaged to move said roller into the ambush position.

12. Cutting apparatus according to claim 5, wherein entry of resilient material to be cut is facilitated by an element resiliently mounted on the lower member outside said peripheral shape and adjacent the cutting blade.

* * * * *